US007832821B2

(12) United States Patent
Morooka

(10) Patent No.: US 7,832,821 B2
(45) Date of Patent: Nov. 16, 2010

(54) INKJET PRINTING APPARATUS

(75) Inventor: Yoshinori Morooka, Mitaka (JP)

(73) Assignee: Canon Finetech Inc., Joso-shi (JP)

( * ) Notice: Subject to any disclaimer, the term of this patent is extended or adjusted under 35 U.S.C. 154(b) by 813 days.

(21) Appl. No.: 11/720,803

(22) PCT Filed: Dec. 28, 2006

(86) PCT No.: PCT/JP2006/326240

§ 371 (c)(1),
(2), (4) Date: Jun. 4, 2007

(87) PCT Pub. No.: WO2007/080806

PCT Pub. Date: Jul. 19, 2007

(65) Prior Publication Data

US 2010/0156975 A1 Jun. 24, 2010

(30) Foreign Application Priority Data

Jan. 10, 2006 (JP) ..... 2006-002609
Jan. 10, 2006 (JP) ..... 2006-002610
Dec. 25, 2006 (JP) ..... 2006-347856

(51) Int. Cl.
*B41J 29/38* (2006.01)
*B41J 29/393* (2006.01)

(52) U.S. Cl. ..... 347/14; 347/13; 347/19

(58) Field of Classification Search ..... 347/13–14, 347/19–20, 42

See application file for complete search history.

(56) References Cited

U.S. PATENT DOCUMENTS 5,587,730 A * 12/1996 Karz ..... 347/43
6,481,820 B1 11/2002 Tamura et al. ..... 347/19
7,422,305 B2 * 9/2008 Wada ..... 347/19

FOREIGN PATENT DOCUMENTS

JP 10-6488 1/1998
JP 11-334047 12/1999

* cited by examiner

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

In an inkjet printing apparatus using plural line type inkjet printing heads for one color ink, and forming an image by dividing image data into pieces corresponding to the plural printing heads, a complementary printing operation using a simple configuration is achieved without causing a substantial decrease in printing speed even when one printing head has a poorly ejecting nozzle. When a one printing head has a poorly ejecting nozzle, a corresponding nozzle of another printing head complements the printing operation assigned to the poorly ejecting nozzle. At this time, the same piece of divided image data is fed to the one and the other printing heads. Then, the printing operation of the one printing head is made invalid only at the timing of driving the poorly ejecting nozzle, and the printing operation of the second printing head is made valid only at the timing of driving the corresponding nozzle.

6 Claims, 14 Drawing Sheets

| | BE2 | BE1 | BE0 | EVEN | ODD | seg No. | | | | | | | | | | | | | | | | | | | | |
|---|---|---|---|---|---|---|---|---|---|---|---|---|---|---|---|---|---|---|---|---|---|---|---|---|---|---|
| BLOCK1 | 0 | 0 | 0 | 0 | 1 | 1 | 3 | 5 | 7 | 65 | 67 | 69 | 71 | 129 | 131 | ... | 453 | 455 | 513 | 515 | 517 | 519 | 577 | 579 | 581 | 583 |
| BLOCK2 | 0 | 0 | 0 | 1 | 0 | 2 | 4 | 6 | 8 | 66 | 68 | 70 | 72 | 130 | 132 | ... | 454 | 456 | 514 | 516 | 518 | 520 | 578 | 580 | 582 | 584 |
| BLOCK3 | 0 | 0 | 1 | 0 | 1 | 9 | 11 | 13 | 15 | 73 | 75 | 77 | 79 | 137 | 139 | ... | 461 | 463 | 521 | 523 | 525 | 527 | 585 | 587 | 589 | 591 |
| BLOCK4 | 0 | 0 | 1 | 1 | 0 | 10 | 12 | 14 | 16 | 74 | 76 | 78 | 80 | 138 | 140 | ... | 462 | 464 | 522 | 524 | 526 | 528 | 586 | 588 | 590 | 592 |
| BLOCK5 | 0 | 1 | 0 | 0 | 1 | 17 | 19 | 21 | 23 | 81 | 83 | 85 | 87 | 145 | 147 | ... | 469 | 471 | 529 | 531 | 533 | 535 | 593 | 595 | 597 | 599 |
| BLOCK6 | 0 | 1 | 0 | 1 | 0 | 18 | 20 | 22 | 24 | 82 | 84 | 86 | 88 | 146 | 148 | ... | 470 | 472 | 530 | 532 | 534 | 536 | 594 | 596 | 598 | 600 |
| BLOCK7 | 0 | 1 | 1 | 0 | 1 | 25 | 27 | 29 | 31 | 89 | 91 | 93 | 95 | 153 | 155 | ... | 477 | 479 | 537 | 539 | 541 | 543 | 601 | 603 | 605 | 607 |
| BLOCK8 | 0 | 1 | 1 | 1 | 0 | 26 | 28 | 30 | 32 | 90 | 92 | 94 | 96 | 154 | 156 | ... | 478 | 480 | 538 | 540 | 542 | 544 | 602 | 604 | 606 | 608 |
| BLOCK9 | 1 | 0 | 0 | 0 | 1 | 33 | 35 | 37 | 39 | 97 | 99 | 101 | 103 | 161 | 163 | ... | 485 | 487 | 545 | 547 | 549 | 551 | 609 | 611 | 613 | 615 |
| BLOCK10 | 1 | 0 | 0 | 1 | 0 | 34 | 36 | 38 | 40 | 98 | 100 | 102 | 104 | 162 | 164 | ... | 486 | 488 | 546 | 548 | 550 | 552 | 610 | 612 | 614 | 616 |
| BLOCK11 | 1 | 0 | 1 | 0 | 1 | 41 | 43 | 45 | 47 | 105 | 107 | 109 | 111 | 169 | 171 | ... | 493 | 495 | 553 | 555 | 557 | 559 | 617 | 619 | 621 | 623 |
| BLOCK12 | 1 | 0 | 1 | 1 | 0 | 42 | 44 | 46 | 48 | 106 | 108 | 110 | 112 | 170 | 172 | ... | 494 | 496 | 554 | 556 | 558 | 560 | 618 | 620 | 622 | 624 |
| BLOCK13 | 1 | 1 | 0 | 0 | 1 | 49 | 51 | 53 | 55 | 113 | 115 | 117 | 119 | 177 | 179 | ... | 501 | 503 | 561 | 563 | 565 | 567 | 625 | 627 | 629 | 631 |
| BLOCK14 | 1 | 1 | 0 | 1 | 0 | 50 | 52 | 54 | 56 | 114 | 116 | 118 | 120 | 178 | 180 | ... | 502 | 504 | 562 | 564 | 566 | 568 | 626 | 628 | 630 | 632 |
| BLOCK15 | 1 | 1 | 1 | 0 | 1 | 57 | 59 | 61 | 63 | 121 | 123 | 125 | 127 | 185 | 187 | ... | 509 | 511 | 569 | 571 | 573 | 575 | 633 | 635 | 637 | 639 |
| BLOCK16 | 1 | 1 | 1 | 1 | 0 | 58 | 60 | 62 | 64 | 122 | 124 | 126 | 128 | 186 | 188 | ... | 510 | 512 | 570 | 572 | 574 | 576 | 634 | 636 | 638 | 640 |

FIG.6

INKJET PRINTING APPARATUS

TECHNICAL FIELD

The present invention relates to an inkjet printing apparatus (hereinafter also referred to as a "line type inkjet printing apparatus" or simply as an "inkjet printing apparatus") using an inkjet printing head (hereinafter also referred to as a "line head") formed of an array of nozzles with the width corresponding to the width of a printing medium to be transferred.

BACKGROUND ART

Line type inkjet printing apparatuses include a general line type inkjet printing apparatus using one line head for one color ink, and a line type inkjet printing apparatus using plural line heads for one color ink, and forming an image by dividing image data into pieces corresponding to the plural line heads. In the latter line type inkjet printing apparatus, the plural line heads share the work of forming an image. This apparatus can therefore achieve a speedup in printing since it enables printing operation beyond the maximum driving frequency of one line head, that is, the printing at a speed proportional to the number of line heads.

In a line type inkjet printing apparatus, one line head may have a poorly ejecting nozzle (hereinafter also referred to as a "faulty nozzle") incapable of ejecting ink normally for some reason or other. Under this condition, in a case of the general line type inkjet printing apparatus, one of the following two approaches can be taken: one of the approaches is to continue to print, without ensuring printing quality; and the other is to suspend printing to replace the line head having the faulty nozzles with a new one. In contrast, in a case of the line type inkjet printing apparatus using the plural line heads for one color ink, another approach can be taken in addition to the above approaches, and this approach is to continue to print by using only normal line heads having no faulty nozzles. Moreover, there is also a technique allowing plural line heads for one color ink to perform complementary operations when a faulty nozzle is detected, that is, allowing each of the plural line heads to eject ink complementarily by using only normal nozzles (see Patent Document 1).

The line type inkjet printing apparatus using the plural line heads for one color ink, however, is originally configured to meet a demand for high-speed printing. The approach of using the normal line heads alone to continue to print, however, cannot satisfy the demand for the high-speed printing because a printing speed is inevitably decreased up to the speed proportional to the number of normal line heads. Here, consider a case where the technique disclosed in Patent Document 1 is applied when a faulty nozzle is detected in a printing apparatus. In this case, in order for normal line heads to complementarily eject ink, the printing apparatus has to rearrange print data and generate mask data, and further requires means for storing the generated mask data. The above technique therefore has the problem of enlarging the scale of circuitry of the printing apparatus because of rendering the mode of control and the configuration of a control system complicated.

[Patent Document 1] Japanese Patent Laid-Open No. 10-6488 (1998))

DISCLOSURE OF THE INVENTION

The present invention has been made in consideration for the foregoing problems inherent in a line type inkjet printing apparatus using plural line heads for one color ink, and forming an image by dividing image data into pieces corresponding to the plural line heads. An object of the present invention is to enable complementary printing operation using a simple configuration while minimizing a decrease in printing speed even when a faulty nozzle is detected.

In order to achieve the above object, the present invention provides an inkjet printing apparatus including a plurality of inkjet printing heads for the same color ink arranged side by side in the conveying direction of a printing medium, each head formed of an array of nozzles for ink ejection in a direction crossing the conveying direction, the apparatus capable of dividing image data into pieces corresponding to the nozzle arrays, feeding the divided image data to the plurality of inkjet printing heads, and printing the divided image data, comprising:

complementing means which, when a poorly ejecting nozzle is present in one ink jet printing heads, causes a corresponding nozzle of another inkjet printing head to complement a printing operation assigned to the poorly ejecting nozzle, wherein the complementing means feeds the same piece of divided image data to the one inkjet printing head and the other inkjet printing head, and the complementing means makes invalid the printing operation of the one inkjet printing head only at a driving timing of the poorly ejecting nozzle, and makes valid the printing operation of the other inkjet printing head only at a driving timing of the corresponding nozzle.

The second inkjet printing head may be provided to to perform the complementarity printing operation.

The second inkjet printing head may be the inkjet printing head in which a nozzle other than the corresponding nozzle is in a poorly ejecting condition.

According to the present invention, when a poorly ejecting nozzle is present in one of the printing heads (or line heads), the same divided image data (or raster data) is fed to the one line head and a different one of the line heads. The printing operation of the one line head is made invalid only at a driving timing of the faulty nozzle (e.g., the timing of the time sharing driving of a block containing the faulty nozzle), and the printing operation of the different line head is made valid only at a driving timing of the corresponding nozzle (e.g., the timing of the time sharing driving of a corresponding block). This eliminates the need for mask data generation, mask data storing means, and so on for complementary operation for the poorly ejecting nozzle. When the different line head is provided to perforin the complementary operation, high-quality printing can be maintained without causing a decrease in printing speed. When the different line head is the line head in which a nozzle other than the corresponding nozzle is in a poorly ejecting condition, the one line head and the different line head complement each other. This does not cause such a substantial decrease in the printing speed that occurs when printing is performed without using these line heads.

BRIEF DESCRIPTION OF THE DRAWINGS

FIG. 6 is a table for explaining correspondences between the signals for block driving and nozzles;

BEST MODES FOR CARRYING OUT THE INVENTION

The present invention will be described in detail below with reference to the accompanying drawings.

First Embodiment

Figure 1:
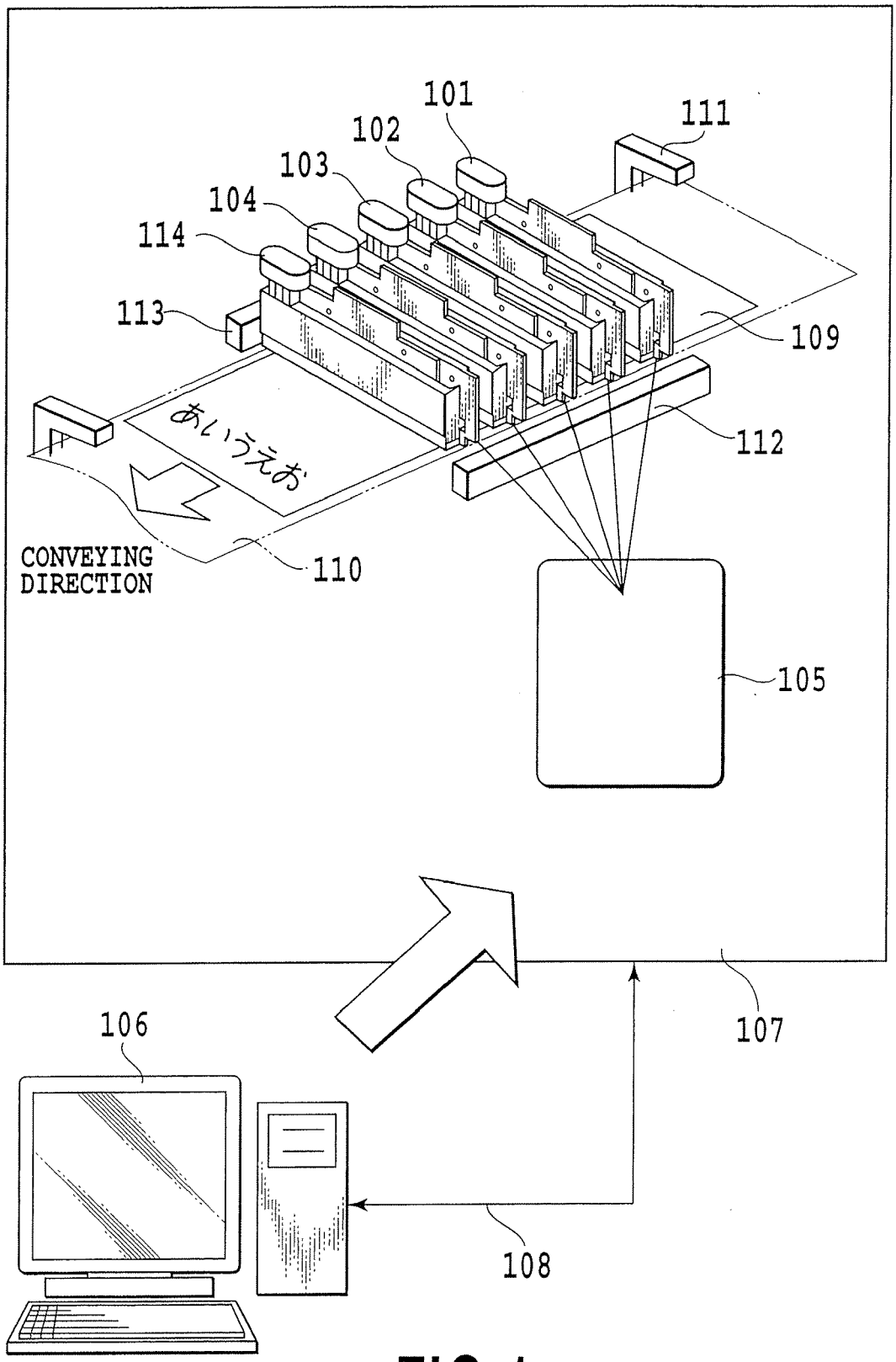
FIG. 1 is a conceptual illustration showing an example of a general configuration of a printing system to which a first embodiment of the present invention can be applied.

FIG. 1 is a conceptual illustration showing an example of a general configuration of a printing system to which the present invention can be applied. The system is configured of a line type inkjet printing apparatus 107 that performs printing operation on a printing medium, and a host computer 106 that transmits and receives various data to and from the inkjet printing apparatus 107. The host computer 106 and the inkjet printing apparatus 107 are connected through a communication cable 108. Moreover, when the host computer 106 transmits various data such as processed image data and a cleaning command to the inkjet printing apparatus 107, the inkjet printing apparatus 107 performs printing and other required operations. When the inkjet printing apparatus 107 transmits a printer status such as error information to the host computer 106, the host computer 106 can recognize the status of the inkjet printing apparatus.

The inkjet printing apparatus according to the first embodiment includes long lengths of four inkjet printing heads (or line heads) 101 to 104, each of which is formed of an array of nozzles with the width corresponding to the width of the printing medium to be transferred, and the line heads 101 to 104 are arranged side by side in the transfer direction of the printing medium. Under normal conditions, the line heads 101 to 104 are used for printing. All of these line heads eject black ink. Image data of the same color (or a black color) is divided into raster units corresponding to the nozzle arrays of the line heads to thereby form print data (or the divided image data). When the print data is then fed to the line heads, the line heads perform their assigned operations for forming a monochrome (or black) image. The printing apparatus according to the first embodiment is provided with another line head 114 (hereinafter also referred to as an "auxiliary line head"), which is used for complementary ink ejection when a faulty nozzle is detected in any of the line heads 101 to 104. Electrothermal transducers (or ejection heaters), for example, can be used for the line heads 101 to 104 and the auxiliary line head 114. Specifically, the electrothermal transducers produce such thermal energy that causes film boiling of the ink according to an applied current, which is utilized as the energy for ink ejection.

A printing medium 109 is transferred along a predetermined conveying path under the line heads 101 to 104 and 114 by a conveyance unit 110 such as a motor-driven endless conveyor belt or conveyor roller. When a front end of the printing medium 109, under this conveying operation, is detected by a printing medium sensor 111 disposed upstream from the line head 101 as viewed in the conveying direction, the printing operation is started on the printing medium 109 at a predetermined time with respect to the time of detection.

A light emitting unit 112 and a photodetector 113 are disposed opposite sides, respectively, of the line heads 101 to 104 and 114. The light emitting unit 112 and the photodetector 113 constitute a faulty nozzle sensing device. The light emitting unit 112 and the photodetector 113 have an array of light emitting elements and an array of photodetection elements, respectively, corresponding to the line heads 101 to 104 and 114. The light emitting elements are arranged to emit light along arrays of nozzle orifices on the undersides of the heads in order for the corresponding photodetection elements to receive the light. For detection operation of a faulty nozzle, optical paths are formed as extending from the light emitting elements to the photodetection elements. Also, the nozzles are made to perform ink ejecting operations in sequence, for example, starting with the nozzles located on one side of the heads and ending with the nozzles located on the other side of the heads. Then, the photodetector 113 detects whether or not a light shield condition is arisen. In this case, a determination can be made as to whether or not each nozzle has performed the ejecting operation normally, according to a driving (or ejection) timing of each nozzle and the timing of detection of whether or not the light shield condition has arisen. When a non-ejecting condition is detected, cleaning operation is performed to improve the performance capabilities of ink ejection. Then, the operation for detecting a faulty nozzle is further performed. When the non-ejecting condition exists even after the cleaning operation, a nozzle in the non-ejecting condition can be judged as a faulty nozzle.

The cleaning operation can be accomplished, for example, by forcing the ink out of the nozzles by applying appropriate pressure to an ink supply system for the heads under a capped condition created by providing caps capable of capping the nozzle forming surfaces of the heads.

The mode of faulty nozzle detection is not limited to automatic detection using the faulty nozzle sensing device as mentioned above, but may be manual detection. For example, firstly, a predetermined test pattern is printed, and then a user makes a visual inspection of the printed result to detect and specify a faulty nozzle, and sets the faulty nozzle in the printing system.

The printing apparatus shown in FIG. 1 can select a printing medium, whether in the form of continuous forms paper or cut sheets, as a print object. Further more, the printing medium may be formed of a mount and a label or tag sheet supported thereon, or in other forms.

Figure 2:
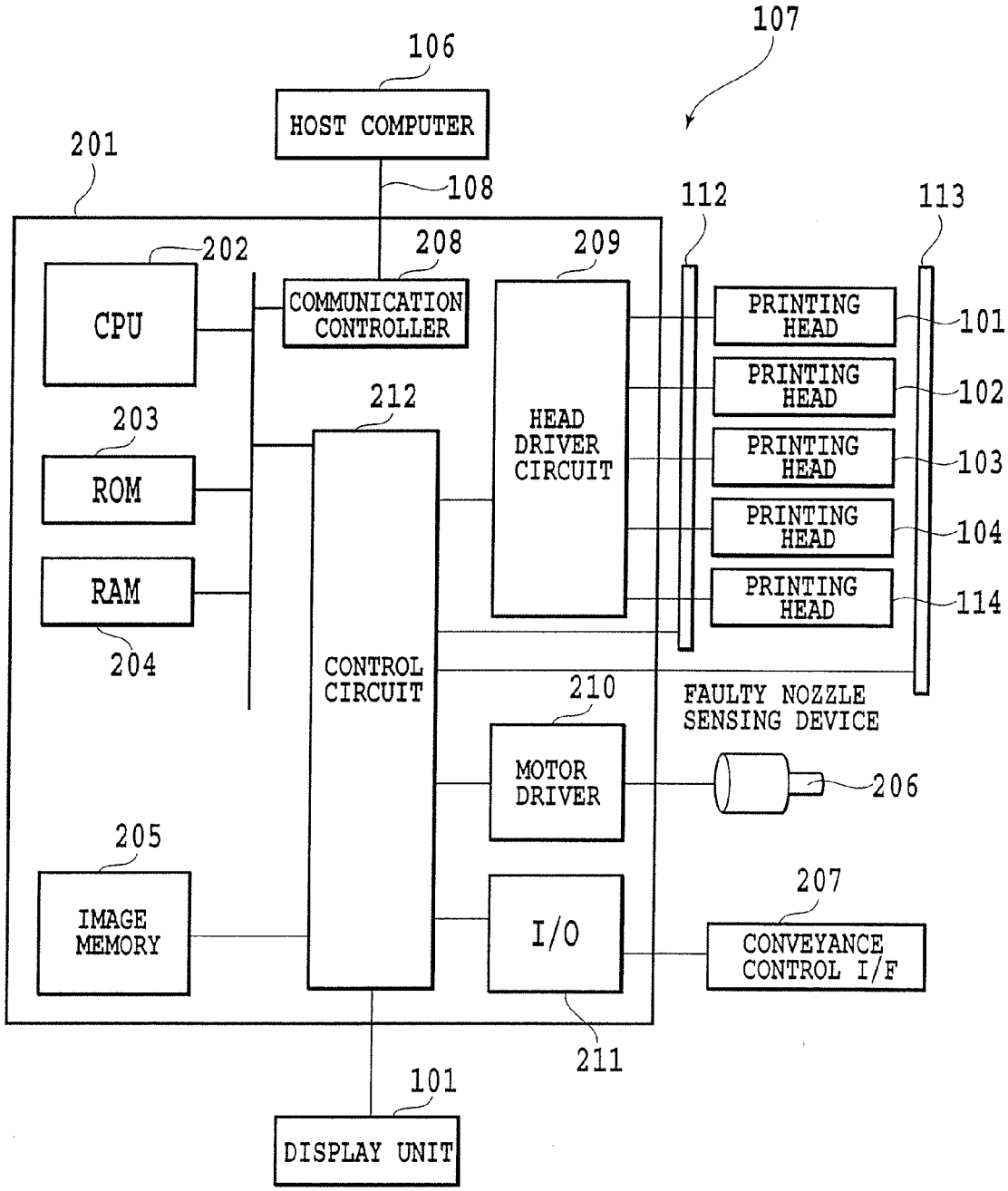
FIG. 2 is a block diagram showing an example of a general configuration of a control system of a line type inkjet printing apparatus according to the first embodiment of the present invention.

FIG. 2 is a block diagram showing an example of a general configuration of a control system of the line type inkjet printing apparatus according to the first embodiment.

As shown in FIG. 2, a controller 201 includes a CPU 202, a ROM 203, a RAM 204, a communication controller 208, an image memory 205, a head driver circuit 209, a motor driver 210, an input/output (I/O) unit 211, and a control circuit 212.

The CPU 202 performs processing of various types, such as calculation, decision making and control, by following a procedure to be described later using FIG. 7 and other procedures. The ROM 203 stores control programs corresponding to the processing procedures which the CPU 202 executes and other fixed data. The RAM 204 has work areas for the CPU 202 to perform data processing of various types, and an area for use in a transmit/receive buffer. The communication controller 208 provides communication of required data between the host computer 106 and the printing apparatus 107 through the communication cable 108. A USB controller, for example, is used as the communication controller 208. Information communicated from the host computer 106 to the printing apparatus 107 includes image data to be printed and a command to execute printing (or printing). Information communicated from the printing apparatus 107 to the host computer 106 includes the status of the printing apparatus 107.

The image memory 205 is used as a unit for arranging the image data to be printed (or printed). The head driver circuit 209 drives the electrothermal transducers of the line heads 101 to 104 and the auxiliary line head 114 at predetermined timings during conveyance of the printing medium in accordance with the image data. The motor driver 210 drives various motors 206 that form a drive source for driving required for the cleaning operation for the line heads 101 to 104 and the auxiliary line head 114, and for the printing operation. The I/O 211 is connected to a conveyance control interface (I/F) 207 for the conveyance unit 110 that feeds and conveys the printing medium. The I/O 211 outputs a start/stop signal to the transfer unit 110 and receives an input of a detection signal from the printing medium sensor 111.

The control circuit 212 controls the image memory 205, the head driver circuit 209, the motor driver 210 and the I/O 211, and also controls the operations of the light emitting unit 112 and the photodetector 113 that constitute the faulty nozzle sensing device. The control circuit 212 also controls a display unit 213 disposed to inform a user of the status and error of the printing apparatus 107.

Figure 3:
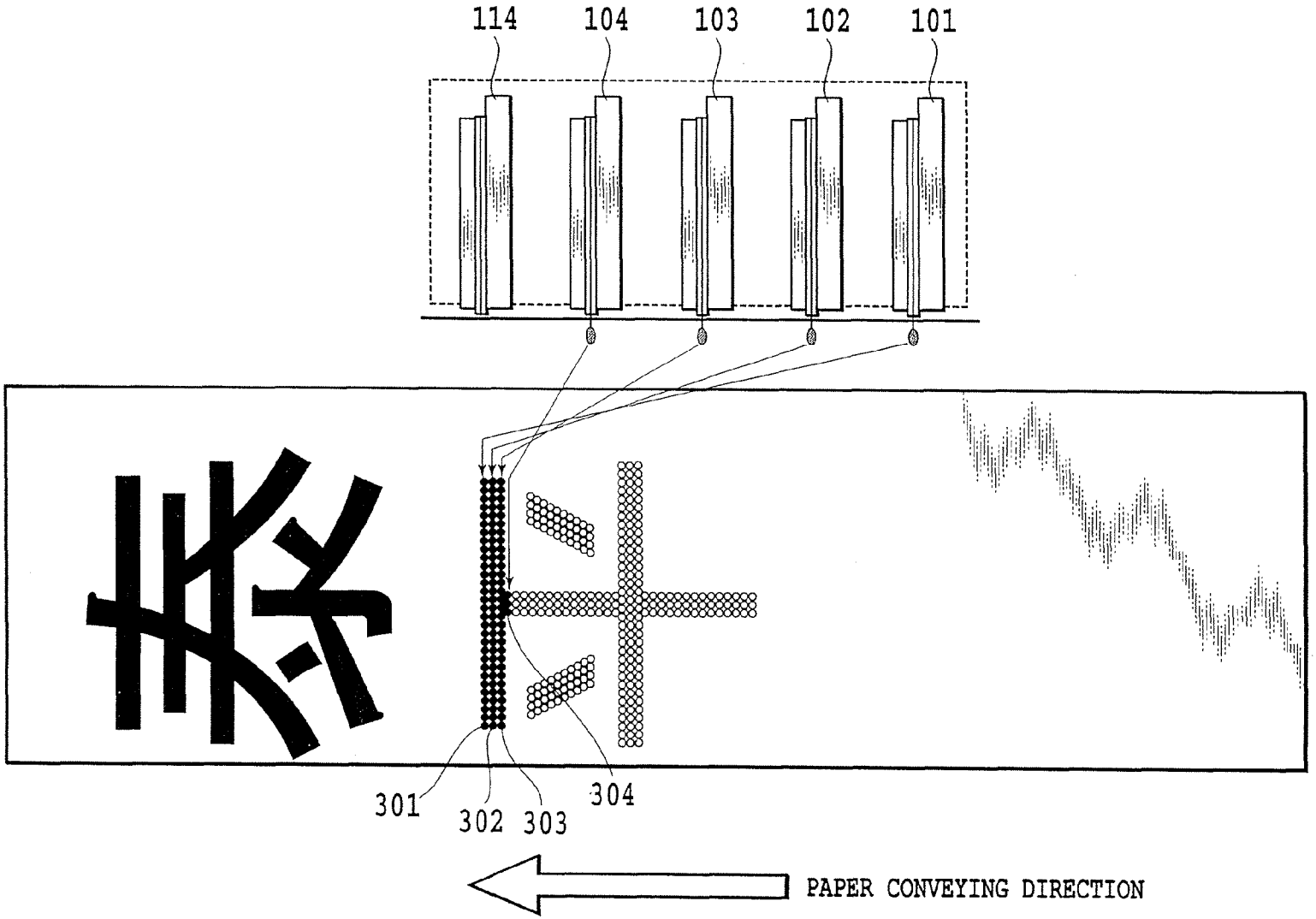
FIG. 3 is a conceptual illustration for explaining the printing operation of the inkjet printing apparatus shown in FIG. 2 under normal conditions.

Description will be given using FIG. 3 with regard to how the inkjet printing apparatus having the above-mentioned configuration performs the printing operation under normal conditions, that is, how the line heads 10 to 104 perform their assigned operations for printing divided image data. In FIG. 3, there are shown, for purposes of illustration, the line heads as viewed from the side and the printing medium as viewed from above. The same goes for FIGS. 8, 11 and 14 to be discussed later.

Printing on the printing medium 109 is performed according to a horizontal synchronization signal in synchronization with the detection signal indicative of detection of the front end of the printing medium 109 and the timing of conveyance of the printing medium 109. As employed herein, the horizontal synchronization signal refers to the signal that is used to set a driving timing of each of the line heads to be driven in sequence.

When a horizontal synchronization signal is detected, a raster of data stored in the image memory 205 is transferred to the line head 101 located on the upstream end as viewed in the conveyance direction of the printing medium, so that a raster image 301 is printed on the printing medium. When the next horizontal synchronization signal is detected, the next raster of image data read out from the image memory 205 is transferred to the line head 102 to form an image 302. When the further next horizontal synchronization signal is detected, the further next raster of image data read out from the image memory 205 is transferred to the line head 103 to form a raster image 303. When the still further next horizontal synchronization signal is detected, the still further next raster of image data read out from the image memory 205 is transferred to the line head 104 to form a raster image 304. Thereafter, the line heads 101 to 104 are used in sequence in the same manner to print image data divided into raster units.

As described above, the printing apparatus according to the first embodiment does not use the auxiliary line head 114 for printing, when all the four line heads configured to eject the black ink can eject the ink under the appropriate conditions. Specifically, monochrome image data arranged in contiguous areas of the image memory 205 is read out in sequence in raster units in synchronization with horizontal synchronization signals, the image data is sequentially fed to and set in the four line heads 101 to 104, and the line heads 101 to 104 perform their assigned operations for printing a monochrome image. Thus, the monochrome image is printed at a frequency up to 4 times the maximum driving frequency of one line head. Consequently, this printing operation achieves 4-times printing throughput, as compared to printing operation using one line head.

In the first embodiment, a predetermined number of nozzles of each line head are grouped as a unit to form a block, and time sharing driving (or block driving) takes place block by block in each line head. Description will now be given with regard to a configuration and the mode of control for the block driving.

In the first embodiment, the line heads 101 to 104 and the auxiliary line head 114 are each provided with an array of 2560 nozzles in a raster direction (hereinafter, the nozzles are designated by the reference characters seg1 to seg2560, starting with the nozzle located on one side and ending with the nozzle located on the other side). Each head is composed of four sections: the nozzles seg1 to seg640 grouped as a unit, the nozzles seg641 to seg1280 grouped as a unit, the nozzles seg1281 to seg1960 grouped as a unit, and the nozzles seg1961 to seg2560 grouped as a unit. In each section, time sharing driving takes place block by block for the purposes of reducing maximum power consumption, reducing a voltage drop in each line head, and doing the like.

Figure 4:
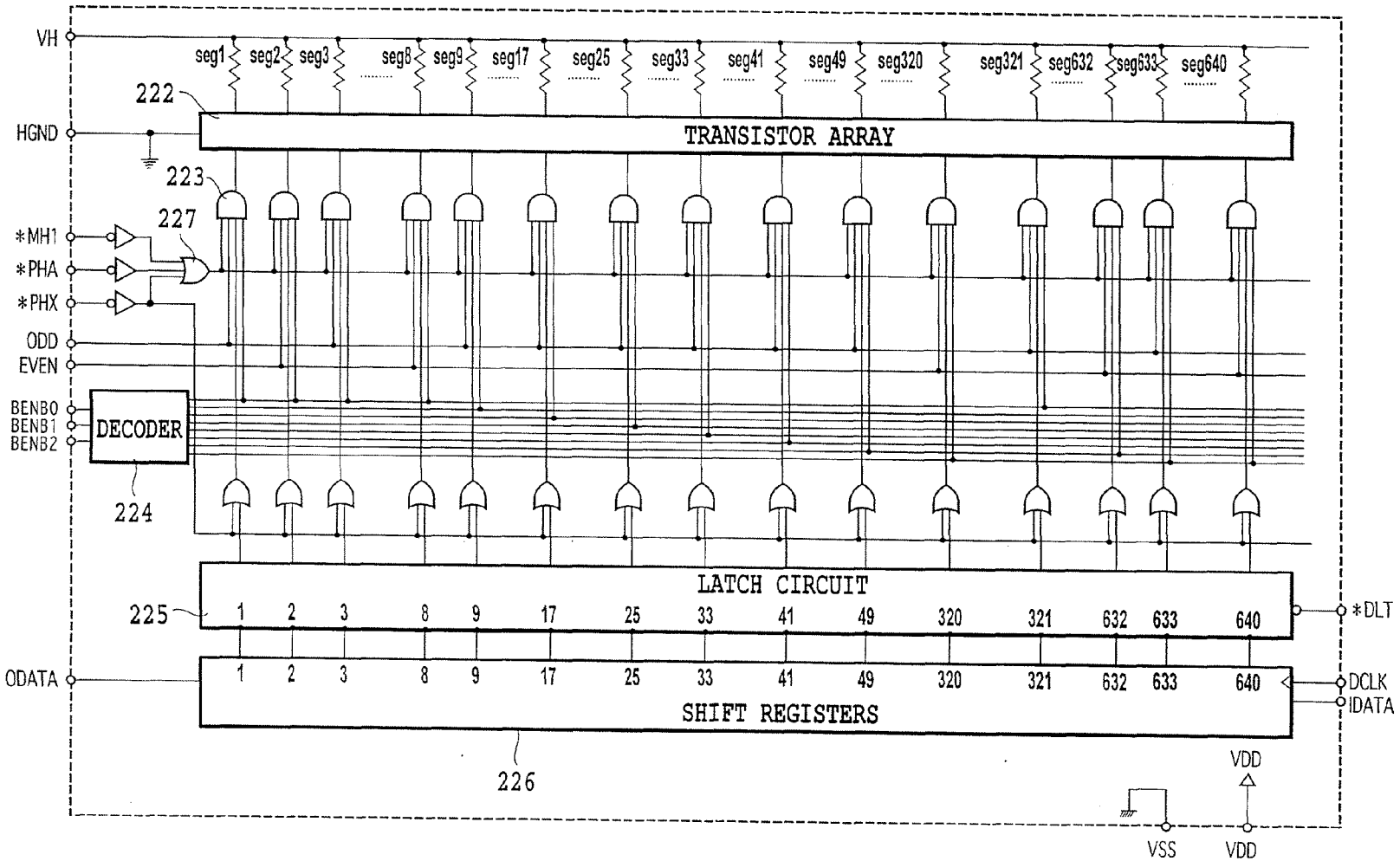
FIG. 4 is a circuit diagram showing an example of an electrical configuration of electrothermal transducers and a driver circuit therefor in a predetermined section of each head of the inkjet printing apparatus shown in FIG. 2.
Figure 5:
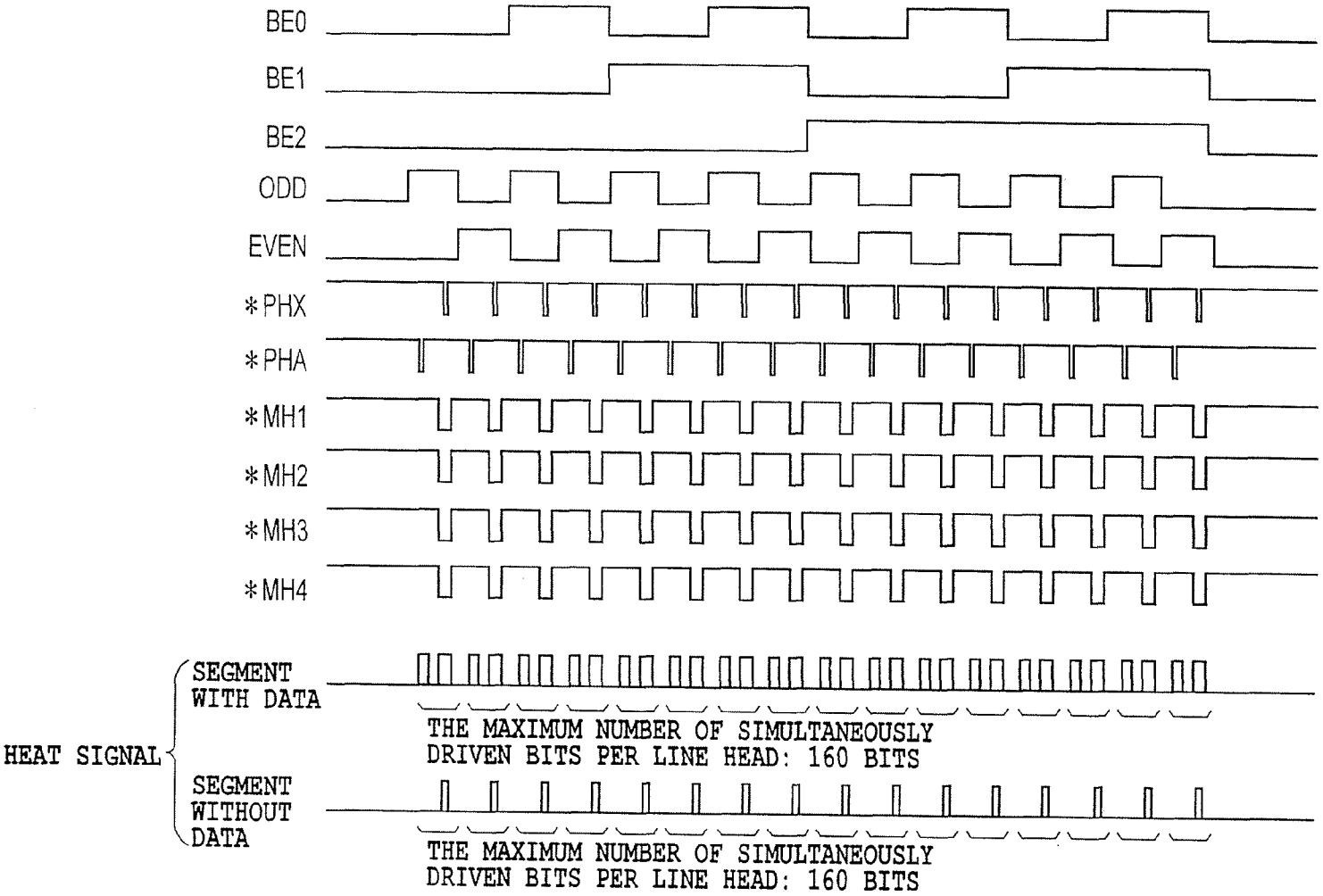
FIG. 5 is a timing chart of signals for block driving from parts in the circuit shown in FIG. 4.

FIG. 4 shows an example of an electrical configuration of the electrothermal transducers and the driver circuit therefor in the section containing the nozzles seg1 to seg640 of each head. FIG. 5 shows a timing chart of signals from parts shown in FIG. 4. FIG. 6 shows correspondences between the signals for block driving and the nozzles seg1 to seg640. The configuration and others shown in these drawings are the same as those of the other sections containing the nozzles seg641 to seg1280, the nozzles seg1281 to seg1960, and the nozzles seg1961 to seg2560, respectively. Even in the other sections, the nozzle indicated by the same block driving signal is driven at the same time.

In FIG. 4, the reference numeral 222 denotes a transistor array for power supply control, which is connected, in conjunction with the electrothermal transducers, to a drive power supply (VH) line for the electrothermal transducers provided in the nozzles seg1 to seg640. The transistor array 222 performs on-off control on each electrothermal transducer.

A decoder 224 generates a signal that specifies the timing of block selection. The decoder 224 outputs eight timing signals in sequence according to three input signals (or 3 bits of parallel signals) BENB0 to BENB2, and the outputted timing signals are fed to any one of four input terminals of each of AND gates 223 connected to the transistor array 222. ODD and EVEN select signals are signals that select odd-numbered and even-numbered nozzles, respectively. The ODD or EVEN select signal is fed to another one of the four input terminals of each corresponding AND gate 223. In other words, the 640 electrothermal transducers are divided into 16 blocks (BLK1 to BLK16 in FIG. 6), each of which contains 40 electrothermal transducers, by the eight timing signals generated according to the signals BENB0 to BENB2 and the ODD/EVEN select signal, and the electrothermal transducers are subjected to time sharing driving block by block. The signal for block selection, which is composed of the eight timing signals generated according to the signals BENB0 to BENB2 and the ODD/EVEN select signal, will be hereinafter called a "block select signal."

A raster of image data (or 2560 bits of data) DATA divided into portions corresponding to the line heads is serially transferred to shift registers 226 disposed in the sections and connected in series, in synchronization with a clock signal DCLK. At the completion of an alignment of data corresponding to the nozzles, the data is then latched into a latch circuit 225 according to a latch signal DLT. The latched data is sent to still another input terminal of the four input terminals of each of the AND gates 223.

In FIG. 4, *PHX, *PHA and *MH1 denote pulses of heat signals (where "*" denotes negative logic), which specify time for the passage of current through the electrothermal transducers in accordance with timing specified by the logic state of the block select signal. These signals are inputted to an OR gate 227, and the ORed output is sent to still another input terminal of the four input terminals of each of the AND gates 223. The signal *MH1 corresponds to the nozzles seg1 to seg640. Signals *MH2, *MH3, and *MH4 are fed to the nozzles seg641 to seg1280, the nozzles seg1281 to seg1960, and the nozzles seg1961 to seg2560, respectively, of the other sections (see FIG. 5.) When there is data to be subjected to the ejecting operation, the electrothermal transducer of each nozzle is then subjected to double-pulse driving by the preceding heat pulse (or prepulse)*PHA and any one of the following pulses (or main pulses)*MH1 to *MH4. When there is not data to be subjected to the ejecting operation, the heat pulse *PHX that specifies such driving time that does not effect the ejecting operation is fed to reduce a temperature variation from the nozzles under the ejecting operation and thus suppress an unevenness of image.

The block select signal and the heat signals mentioned above are individually fed from the control circuit 212 shown in FIG. 2 to the line heads 101 to 104 and the auxiliary line head 114, and these signals can be independently controlled. The electrothermal transducer of each nozzle, when selected by the block select signal, is supplied with current for the period of time specified by the heat pulses according to the presence or absence of data. In the first embodiment, a raster is divided into 16 portions for the ejecting operations, and therefore the maximum number of simultaneously driven nozzles per line head is 160.

Description will now be given using the above configuration with regard to complementary operation which takes place when a faulty nozzle is detected. The complementary operation according to the first embodiment is performed in block units divided as mentioned above by using the auxiliary line head 114.

Figure 7:
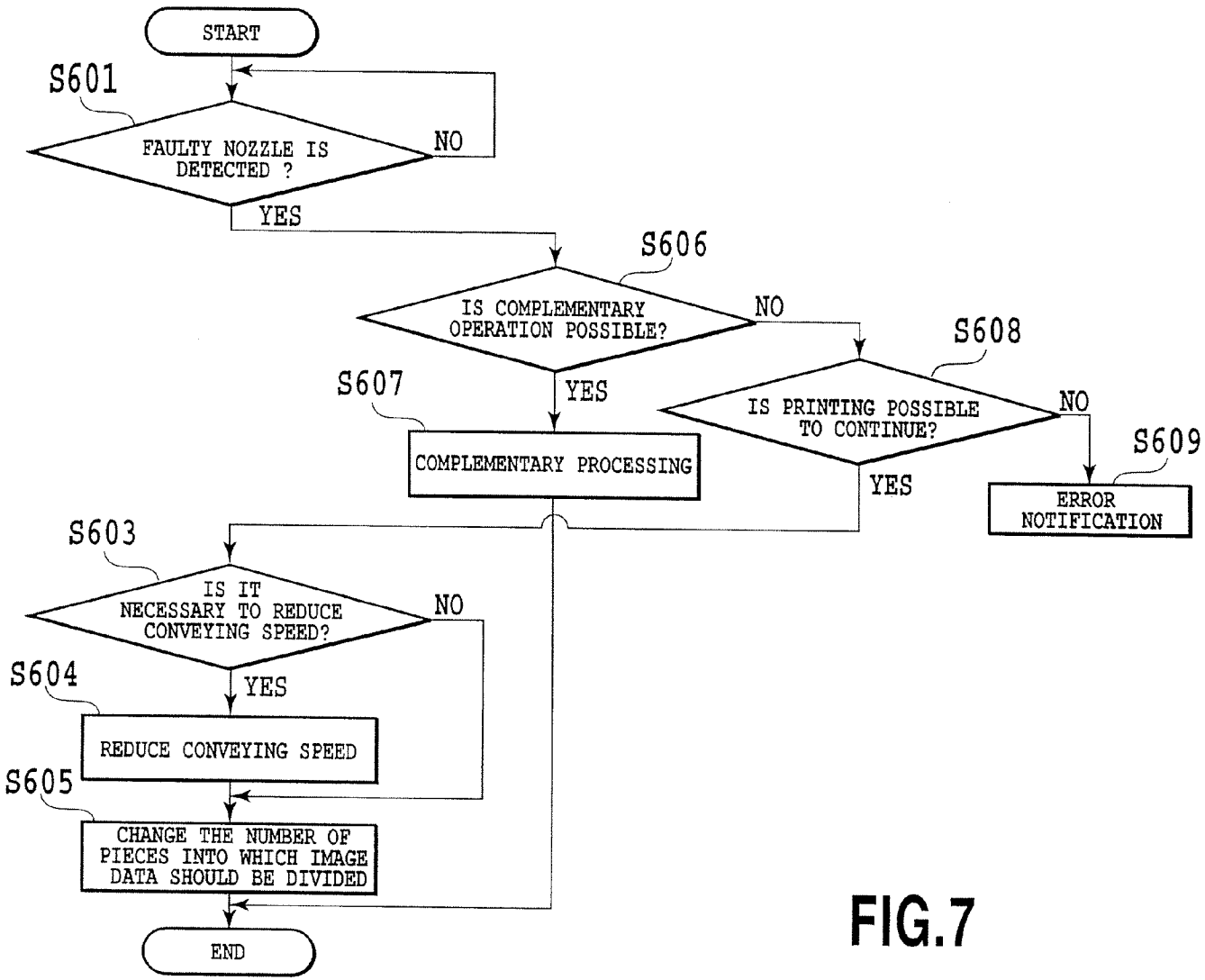
FIG. 7 is a flowchart showing an example of the procedure for complementary operation executed when a faulty nozzle is detected, according to the first embodiment of the present invention.

FIG. 7 is a flowchart showing an example of the procedure for complementary operation which is executed when a faulty nozzle is detected. When the faulty nozzle sensing device previously described detects a faulty nozzle (at step S601), a determination is made as to whether or not the complementary operation using the auxiliary line head 114 is possible (at step S606). The step of making a determination can include the following steps, for example.

Specifically, a determination is first made as to whether or not all nozzles belonging to a block in the auxiliary lie head 114 corresponding to a block of a line head containing the detected faulty nozzle can normally eject the ink. When all the nozzles can eject the ink normally, the complementary operation using the auxiliary line head 114 is enabled. However, when a faulty nozzle is present also in the corresponding block of the auxiliary line head, a determination is made as to whether or not a section of the auxiliary line head containing this faulty nozzle corresponds to a section of the line head containing the faulty nozzle. Then, when these sections do not correspond to each other, the complementary operation using the auxiliary line head 114 is enabled. In contrast, when these sections correspond to each other, the complementary operation using the auxiliary line head 114 is disabled. In other words, when a faulty nozzle is detected in a line head, a determination is made as to whether or not both a block and a section containing this faulty nozzle coincide with both a block and a section of the auxiliary line head containing a faulty nozzle. Only when the former block and section coincide with the latter block and section, the complementary operation using the auxiliary line head 114 is disabled.

When the complementary operation using the auxiliary line head 114 is possible, setting is made for complementary processing to be described later (at step S607), and the procedure is terminated. When the complementary operation using the auxiliary line head 114 is impossible, a determination is made as to whether or not printing can be executed (at step S608). The step of making a determination can be performed in the following manner. Specifically, when faulty nozzles are present in all line heads and all the faulty nozzles belong to corresponding blocks and sections (or matching blocks and sections as viewed in the conveyance direction), a determination is made that the printing is impossible. Otherwise, a determination is made that the printing is possible.

When the execution of the printing is possible, a determination is made as to whether or not it is necessary to reduce the conveying speed of the printing medium according to the number of available line heads capable of normal printing (at step S603). It is necessary to reduce the conveying speed, for example, when the number of available line heads is less than 4. In this case, the conveying speed is set according to the number of the available line heads and the maximum driving frequency of each line head. Then, the number of portions into which image data should be divided is changed according to the number of the available line heads, regardless of whether or not it is necessary to reduce the conveying speed. Then, the procedure is terminated.

In contrast, when at step S608 a determination is made that the execution of the printing is impossible, the printing operation is stopped. The display unit 213 of the inkjet printing apparatus is driven to provide an error indication, and an error signal is transmitted to the host computer 106 so that a display of the host computer 106 provides an error indication (at step S609). The error indication may give detailed error information such as the location of the line head having the faulty nozzle detected therein, or may give instructions as to how to deal with an error to a user or do the like. When at step S603 a determination is made that it is necessary to reduce the conveying speed of the printing medium, the display unit 213 of the inkjet printing apparatus or the display of the host computer 106 may be used to inform the user that the conveying speed or printing speed is reduced. When the printing speed is reduced, a procedure may be performed as given below. An inquiry is made as to whether or not a user accepts a reduction in the printing speed. When the user accepts it, the printing is continued. Otherwise, an error message is given to the user.

Description will now be given more specifically with regard to complementary operation which takes place when a faulty nozzle is detected. At this point, there is given an instance where a faulty nozzle is detected in the line head 102 and the faulty nozzle is seg65 belonging to BLOCK1 of the section consisting of the nozzles seg1 to seg640 (see FIG. 6.)

In this case, when the auxiliary line head 114 does not have a faulty nozzle in BLOCK1 of the section consisting of the nozzles seg1 to seg640, the complementary operation can be judged as being possible using a group of nozzles belonging to BLOCK1 of the corresponding section of the auxiliary line head 114. In contrast, when the auxiliary line head 114 has a faulty nozzle in BLOCK1 of the section consisting of the nozzles seg1 to seg640, the complementary operation using the auxiliary line head 114 is judged as being impossible.

Figure 8:
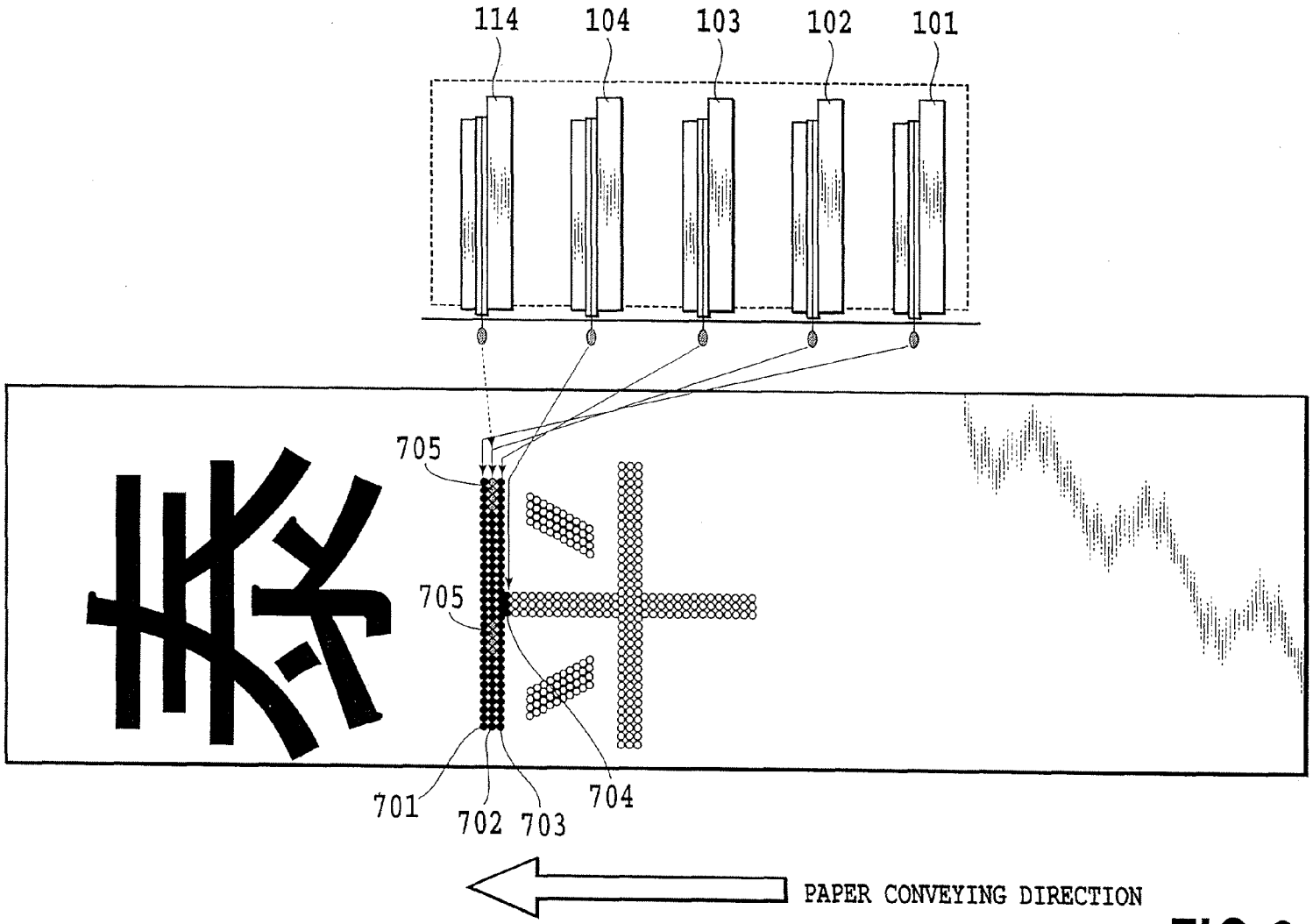
FIG. 8 is a conceptual illustration for explaining the complementary operation using an auxiliary line head, executed when a faulty nozzle is detected, according to the first embodiment of the present invention.
Figure 9:
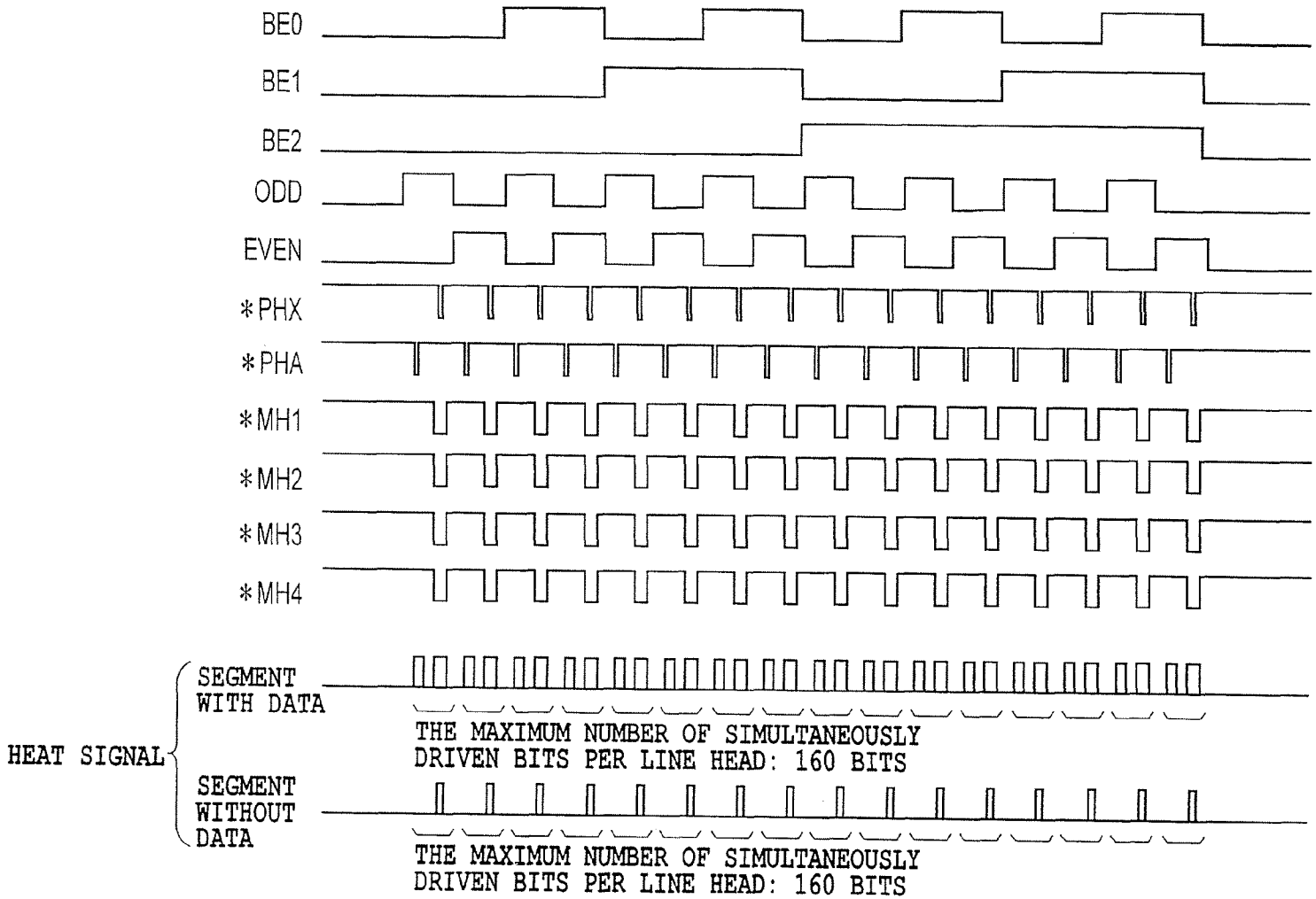
FIG. 9 is a timing chart of signals from parts in a line head having a faulty nozzle detected therein.
Figure 10:
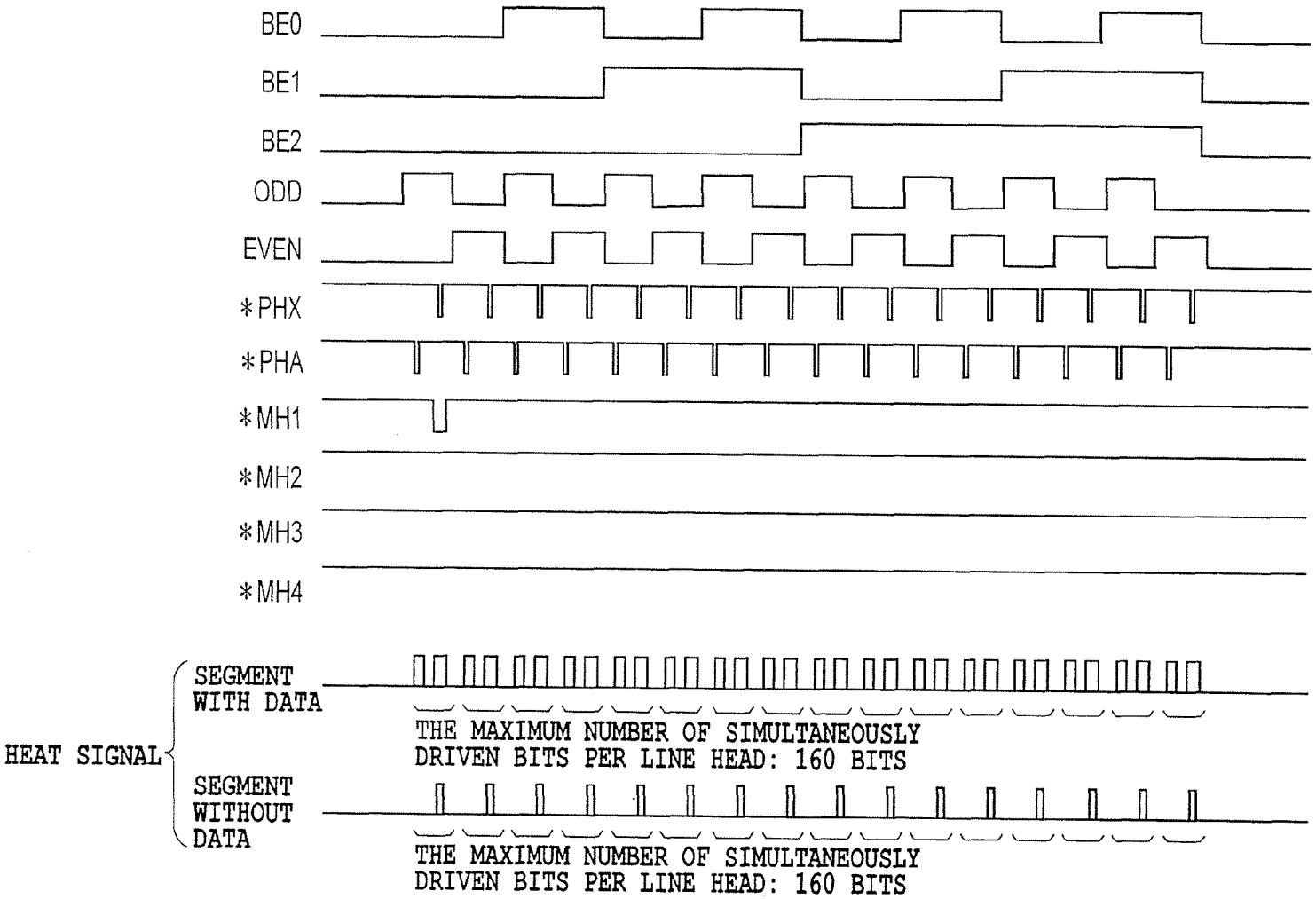
FIG. 10 is a timing chart of signals from parts in an auxiliary line head.

FIG. 8 is an illustration for explaining a complementary operation using the auxiliary line head 114. FIGS. 9 and 10 are timing charts of signals from parts in the line head having the faulty nozzle detected therein and the auxiliary line head, respectively.

When the front end of the printing medium 109, after the start of the conveying operation, is detected by the printing medium sensor 111, and issue of a horizontal synchronization signal in synchronization with the conveyance of the printing medium is started. The horizontal synchronization signal is generated by converting an output signal from means (not shown), such as a rotary encoder, provided on the conveying path. When the printing head has a resolution of, for example, 600 dots per inch (as a reference value), a pulse of a horizontal synchronization signal is sent out every time the printing medium 109 travels a distance equal to a dot pitch, specifically, 42.3 μm. When the design value of the distance between the printing medium sensor 111 and the line head 101 located on the upstream end is 2 inches, 1200 pulses of horizontal synchronization signals are sent out during the period of time between the detection of the front end of the printing medium by the printing medium sensor 111 and the arrival of the front end thereof at the line head 101.

When a further travel of the printing medium 109 results in a print starting point reaching the underside of the line head 101, a raster of data of a top portion stored in the image memory 205 is transferred to the line head 101 so that a top raster image is printed on the printing medium. Thereafter, the line head 101 performs such intermittent image printing that involves printing a raster image for every advance in four pulses of horizontal synchronization signals.

When the position of the second raster from the top then reaches the underside of the line head 102, an image of the second raster from the top is printed on the printing medium. If the design value of the distance between the line heads is 1 inch, the line head 102 starts printing after about 600 pulses of horizontal synchronization signals have been sent out as counted since the start of printing by the line head 101. Thereafter, the line head 102 likewise performs such intermittent image printing that involves printing a raster image for every advance in four pulses of horizontal synchronization signals.

Thereafter, the line heads 103, 104 and 114, in turn, on the downstream side likewise make up for printing of intermittent raster portions to start completing an image, every time about 600 pulses of horizontal synchronization signals are sent out.

Description will be given focusing attention on rasters 701 to 704 in the process of image printing after further progress.

When the position of the raster 702 reaches the underside of the printing head 102, image data of the raster is read out from the image memory 205 and transferred to the line head 102. At this time, the block select signal and the heat signal are appropriately controlled to make valid driving of the nozzles belonging to BLOCK2 to BLOCK16 of the section consisting of seg1 to seg640 and driving of all the nozzles belonging to BLOCK1 to BLOCK16 of each of the sections consisting of seg641 to seg1280, seg1281 to seg1960, and seg1961 to seg2560, respectively. In other words, the main pulse MH1 alone is made invalid at the timing when the line head 102 is such that BE0=0, BE1=0, BE2=0, ODD=1, and EVEN=0 (see FIG. 9.) Thus, the raster portion 702 (or a group of dots shown by black circles in FIG. 8) is formed. As this point in time, the printing medium goes ahead with a faulty-nozzle-containing block 705 unprinted. After passing under the printing head 102, the raster 702 reaches the underside of the auxiliary line head 114 at the time when about 1800 pulses of horizontal synchronization signals are sent out.

Since the auxiliary line head 114 is preloaded, in the same order, with the same data as the image data read out for the printing head 102, the image data of the raster 702 is read out from the image memory 205 and transferred to the auxiliary line head 114.

At this time, the block select signal and the heat signal are appropriately controlled to make valid only driving of the nozzles belonging to BLOCK1 of the section consisting of seg1 to seg640. In other words, the main pulse MH1 alone is made valid at the time when the auxiliary line head 114 is such that BE0=0, BE1=0, BE2=0, ODD=1, and EVEN=0 (see FIG. 10.) Thus, the raster image portion 705 (or hatched dots in FIG. 8) is formed to complement an image.

Description will now be given with regard to an operation which takes place when the auxiliary line head 114 has a faulty nozzle in BLOCK1 of the section consisting of seg1 to seg640, and accordingly the complementary operation using the auxiliary line head 114 is judged as being impossible.

Here, assume that the other line heads 101, 103 and 104 do not contain a faulty nozzle, and thus a determination is made that these three line heads can be used to continue to print. In this case, a determination is made as to whether or not the current conveying speed of the printing medium 109 allows the other three line heads to perform the printing, according to the period of the horizontal synchronization signal. When the conveying speed does not permit the printing, the conveying speed is then controlled to decrease to a speed that permits the printing. The maximum conveying speed that permits the printing is proportional to the number of printing heads. Thus, a control program can be used to preset in a table the maximum speed that permits the printing according to the number of printing heads and to appropriately read out and use the set speed. After the setting of the speed that permits the printing, the number of portions into which image data should be divided is changed from "4" to "3".

Figure 11:
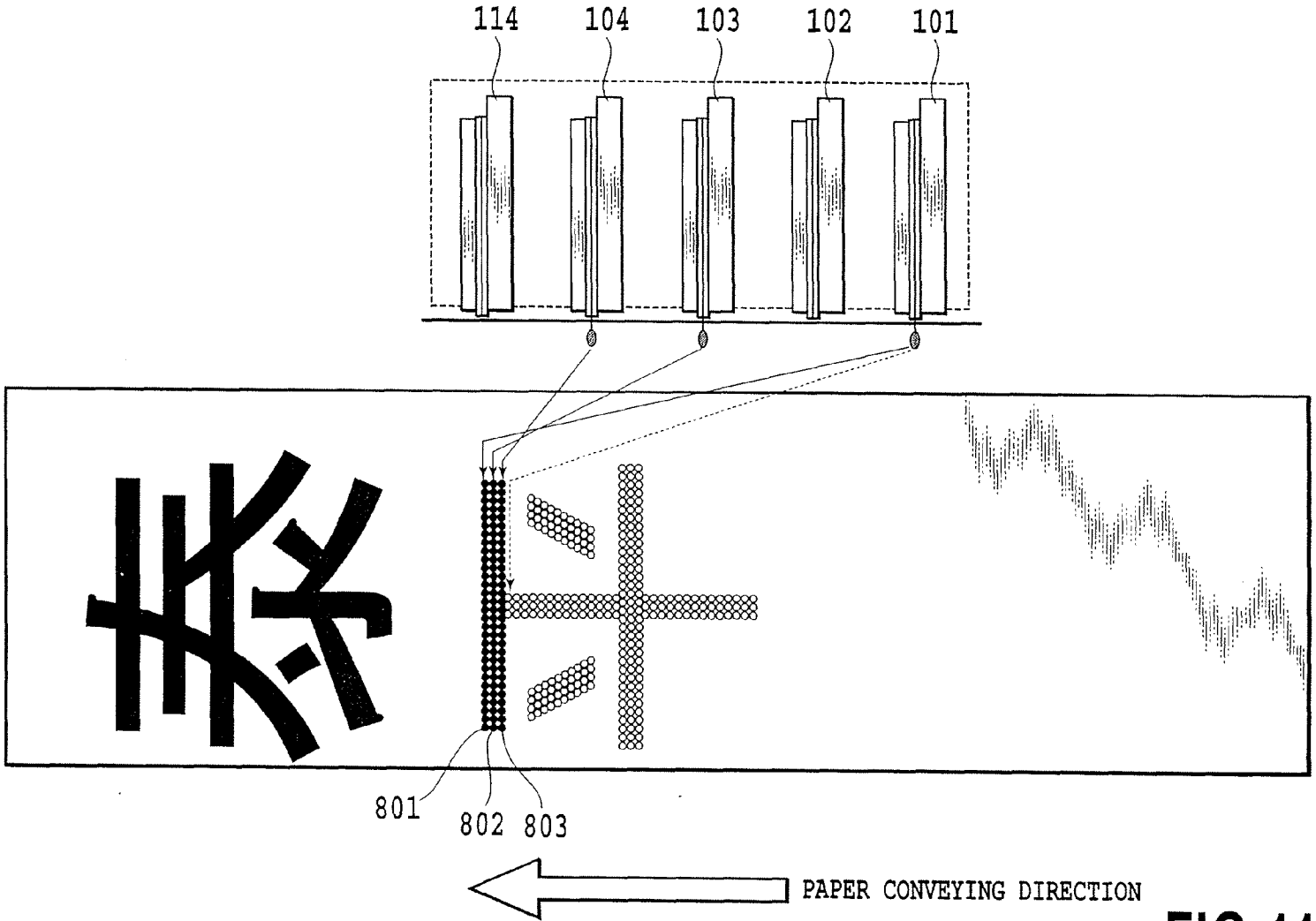
FIG. 11 is a conceptual illustration for explaining the printing operation performed without using the auxiliary line head when a faulty nozzle is detected, according to the first embodiment of the present invention.

FIG. 11 shows the results of printing, which are obtained when the three line heads 101, 103 and 104 capable of printing are used to print rasters 801 to 803 in the process of image printing.

When a print starting point reaches the underside of the line head 101, a raster of data of a top portion stored in the image memory 205 is transferred to the line head 101 so that a top raster image is printed on the printing medium. Thereafter, the line head 101 performs such intermittent image printing that involves printing a raster image for every advance in three pulses of horizontal synchronization signals.

When the position of the second raster from the top then reaches the underside of the line head 103, an image of the second raster from the top is printed on the printing medium. Since the design value of the distance between the line heads is set to 1 inch, the line head 103 starts printing after about 1200 pulses of horizontal synchronization signals are sent out as counted since the start of printing by the line head 101. Thereafter, the line head 103 likewise performs such intermittent image printing that involves printing a raster image for every advance in three pulses of horizontal synchronization signals.

When about 600 pulses of horizontal synchronization signals are further sent out, the line head 104 performs printing to start completing an image.

As described above, when the complementary operation using the auxiliary line head 114 is impossible, the line heads other than the line head 114, that is, the normal line heads having no faulty nozzles, are used for printing, and thereby achieving image formation without degradation of printing quality although resulting in the decreased printing speed.

As described above, the printing apparatus according to the first embodiment uses the auxiliary line head to perform the complementary operation block by block in a spatially corresponding section, that is, a corresponding section positions as viewed in the conveying direction, according to the timing of the block select signal. This enables the complementary operation by controlling the reading and transfer of image data in raster units arranged in the image memory and by controlling the signal state of the heat signal (or the main heat pulse). Consequently, the printing apparatus according to the first embodiment eliminates a faulty nozzle complementing operation that involves image data re-arrangement, mask data generation, mask data storing means, and so on, and thus achieves the effect of being able to maintain high-quality printing using a simple configuration without causing a decrease in the printing speed.

Moreover, when the complementary operation using the auxiliary line head is impossible, the printing apparatus according to the first embodiment changes the number of portions into which image data should be divided according to the number of line heads capable of printing operation, and also sets an appropriate conveying speed of the printing medium according to the number of the line heads. This enables image formation without degradation of the printing quality, while minimizing a decrease in the printing speed.

Although the description has been given to the above first embodiment with regard to the operation which takes place when a faulty nozzle is detected in one of the line heads other than the auxiliary line head, it is understood that the present invention is not limited to the above. Even when faulty nozzles are detected in two or more of the printing heads other than the auxiliary line head, the auxiliary line head can be used to achieve high-quality printing without reducing the printing speed, unless blocks having the faulty nozzles detected therein coincide with corresponding blocks of the auxiliary line head.

In the above first embodiment, four line heads and one auxiliary line head are used for normal printing. However, it will be, of course, understood that the numbers of heads given above are illustrative only and the appropriate numbers of heads may be used.

Although the printing apparatus according to the first embodiment mentioned above is provided with the auxiliary line head fixedly intended for the purpose, the line head to function as the auxiliary line head may appropriately change from one to another of plural line heads. Specifically, any one of the plural line heads may be cyclically or randomly prepared to act as the auxiliary line head, for example, every time a predetermined amount of image printing occurs. Alternatively, the printing apparatus may be configured in the following manner: when a faulty nozzle is detected in one of the line heads, this line head having the faulty nozzle is set up to act as the auxiliary line head for next printing, and the line head that has been prepared to act as the auxiliary line head is switched to the line head for use in normal printing. When a faulty nozzle is then detected in any of the line heads, the printing apparatus may perforin the same processing as described above.

Specifically, the printing apparatus may compare a block having the faulty nozzle detected therein to a faulty-nozzle-containing block of the line head set up to act as the auxiliary line head.

Second Embodiment

Figure 12:
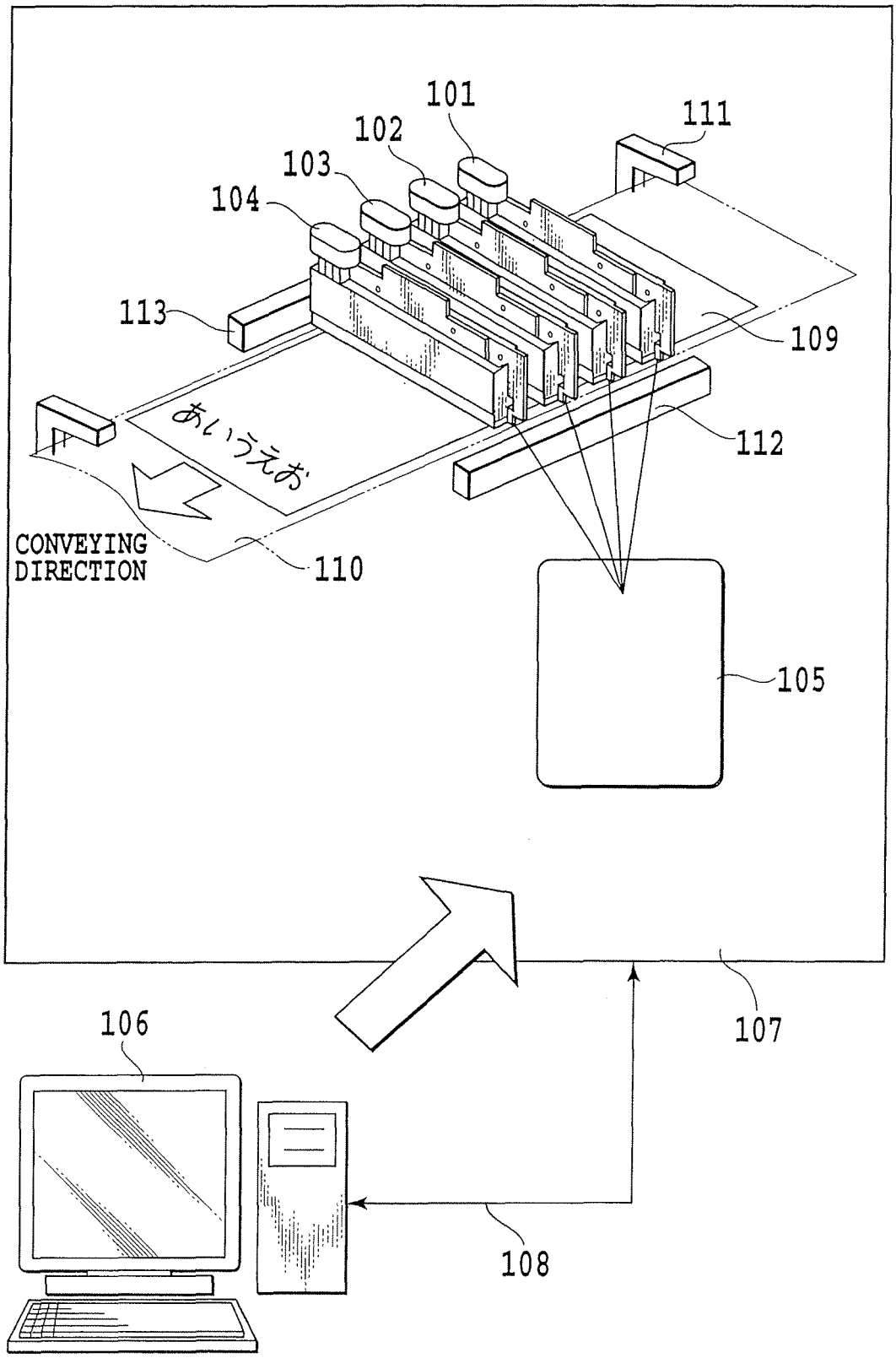
FIG. 12 is a conceptual illustration showing an example of a general configuration of a printing system to which a second embodiment of the present invention can be applied.

FIG. 12 is a conceptual illustration showing an example of a general configuration of a printing system according to a second embodiment of the present invention. In FIG. 12, corresponding parts configured in the same manner as described for the first embodiment are designated by the same reference numerals. As is apparent from FIG. 12, the system according to the second embodiment is not provided with the auxiliary line head and is provided with only the four line heads 101 to 104 that are used for printing under normal conditions.

A control system of the printing system according to the second embodiment is also configured in the same manner as shown in FIG. 2. However, this control system is adapted for the configuration not having the auxiliary line head 114.

The printing operation of the printing system under normal conditions is also the same as the operation described for the first embodiment using FIG. 3, specifically the assigned printing operations of the line heads 101 to 104 without the use of the auxiliary line head 114.

Also in the second embodiment, the block driving mentioned above takes place in each line head. A configuration for the block driving and the mode of control therefor under normal printing conditions are the same as the configuration and mode according to the first embodiment described using FIGS. 4 to 6.

Description will now be given using the above configuration with regard to complementary operation which takes place when a faulty nozzle is detected. The complementary operation according to the second embodiment is performed in divided block units as mentioned above.

Figure 13:
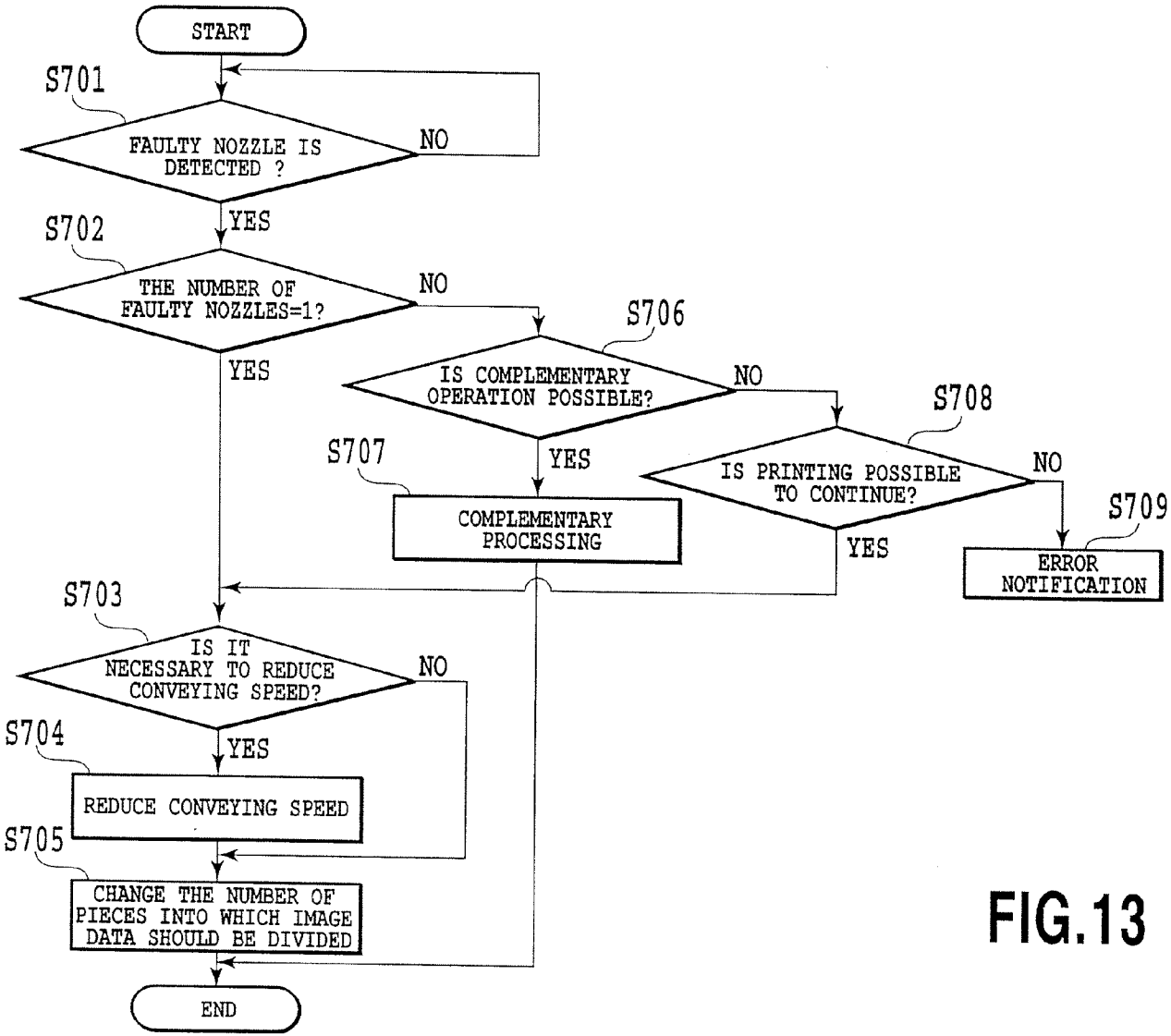
FIG. 13 is a flowchart showing an example of a procedure for complementary operation which is executed when a faulty nozzle is detected, according to the second embodiment of the present invention.

FIG. 13 is a flowchart showing an example of a procedure for complementary operation which is executed when a faulty nozzle is detected. When the faulty nozzle sensing device previously described detects a faulty nozzle (at step S701), a determination is made as to whether or not the faulty nozzle is present in only one line head (at step S702).

When the faulty nozzle is present in only one line head, printing is executed using the other three line heads capable of normal printing, and a determination is made as to whether or not it is necessary to reduce the conveying speed of the printing medium according to the number of other line heads (i.e., three) (at step S703). Specifically, a decline in the number of line heads containing no faulty nozzles requires a lower conveying speed than the maximum printing speed achieved by printing using the four line heads, according to the maximum printing frequency of the other line heads. Thus, a determination is made as to whether or not the printing operation can be executed at the currently set conveying speed as it is. It is necessary to reduce the conveying speed, when the maximum printing speed is an initially set speed. In this case, the conveying speed is set according to the number of the other line heads and the maximum driving frequency of each line head. Then, the number of portions into which image data should be divided is changed according to the number of the available line heads, regardless of whether or not it is necessary to reduce the conveying speed (at step S705). Then, the procedure is terminated.

When faulty nozzles are present in two or more line heads at step S702, a determination is made as to whether or not complementary operation using the relation between the line heads is possible (at step S706). The step of making a determination, for example, can be performed by the following steps.

Specifically, as for the relation between the line heads containing the faulty nozzles, a determination is first made as to whether or not blocks included respectively in the line heads and containing the faulty nozzles coincide with each other. When the blocks do not coincide with each other, the complementary operation is immediately judged as being possible. When the blocks coincide with each other, a determination is made as to whether or not sections having the faulty nozzles correspond to each other. When the sections do not correspond to each other, the complementary operation is enabled. When the sections correspond to each other, the complementary operation is disabled. In other words, when faulty nozzles are detected in two or more line heads, a determination is made as to whether not only the blocks containing the faulty nozzles but also the sections containing the faulty nozzles overlap with each other. Only when both of the blocks and the sections coincide with each other, the complementary operation is disabled.

When the complementary operation is possible, setting is made for complementary processing to be described later (at step S707), and the procedure is terminated. When the complementary operation is impossible, a determination is made as to whether or not printing can be executed (at step S708). The step of making a determination can be performed in the following manner. Specifically, when faulty nozzles are present in all line heads and the faulty nozzles belong to corresponding blocks and sections (or matching blocks and sections as viewed in the conveying direction), a determination is made that the printing is impossible. Otherwise, a determination is made that the printing is possible.

When a determination is made that the execution of the printing is possible at step S708, the procedure goes to step S703, where the process for reducing the conveying speed or other processes are then executed. When a determination is made that the execution of the printing is impossible at step S708, the printing operation is stopped. The display unit 213 of the inkjet printing apparatus is driven to provide an error indication, and an error signal is transmitted to the host computer 106 so that the display of the host computer 106 provides an error indication (at step S709). The error indication may give detailed error information such as the locations of the line heads having the faulty nozzles detected therein, or may give instructions to a user on how to deal with an error or do the like. When a determination is made that it is necessary to reduce the conveying speed of the printing medium at step S703, the display unit 213 of the inkjet printing apparatus or the display of the host computer 106 may be used to inform the user that the conveying speed is reduced. When the printing speed is reduced, a procedure may be performed as given below. An inquiry is made as to whether or not a user accepts a reduction in the printing speed. When the user accepts it, the printing is continued. Otherwise, an error message is given to the user.

Description will now be given more specifically with regard to the printing operation which takes place when a faulty nozzle is detected. At this point, assume that a faulty nozzle is detected only in the line head 102, and that the other line heads 101, 103 and 104 do not contain a faulty nozzle.

In this case, a determination is made as to whether or not the current conveying speed of the printing medium 109 allows the other three line heads to perform the printing, according to the period of the horizontal synchronization signal. When the conveying speed does not permit the printing, the conveying speed is then controlled to decrease to a speed that permits the printing. The maximum conveying speed that permits the printing is proportional to the number of printing heads. Thus, a control program can be used to preset in a table the maximum speed that permits the printing according to the number of printing heads, and to appropriately read out and to use the set speed. After setting the speed that permits the printing, the number of portions into which image data should be divided is changed from "4" to "3."

Thereafter, the three line heads 101, 103 and 104 capable of printing perform the printing operation. This printing operation is the same as the operation described, for example, in the first embodiment using FIG. 11, specifically the assigned printing operations of the line heads 101, 103 and 104 without the use of the auxiliary line head 114.

In short, in the second embodiment, the other three line heads are used for printing when a faulty nozzle is present in only one line head. In this case, the normal line heads containing no faulty nozzles are used to perform printing in raster units, thus achieving image formation without degradation of the printing quality, although causing a decrease in the printing speed from the maximum printing speed if the maximum printing speed achieved by using the four line heads is the initially set speed.

However, assume that a faulty nozzle is then detected also in the line head 103, for example. In this case, at the above step S706 a determination is made as to whether or not the complementary operation is possible according to the relation between the line heads 102 and 103 in which the faulty nozzles are present. At this point, assume that both of the sections and the blocks having the faulty nozzles detected in the line heads 102 and 103 do not coincide with each other. In this case, the complementary operation for the faulty nozzles in the line heads 102 and 103 can be performed by appropriately controlling driving of the line heads 102 and 103.

Figure 14:
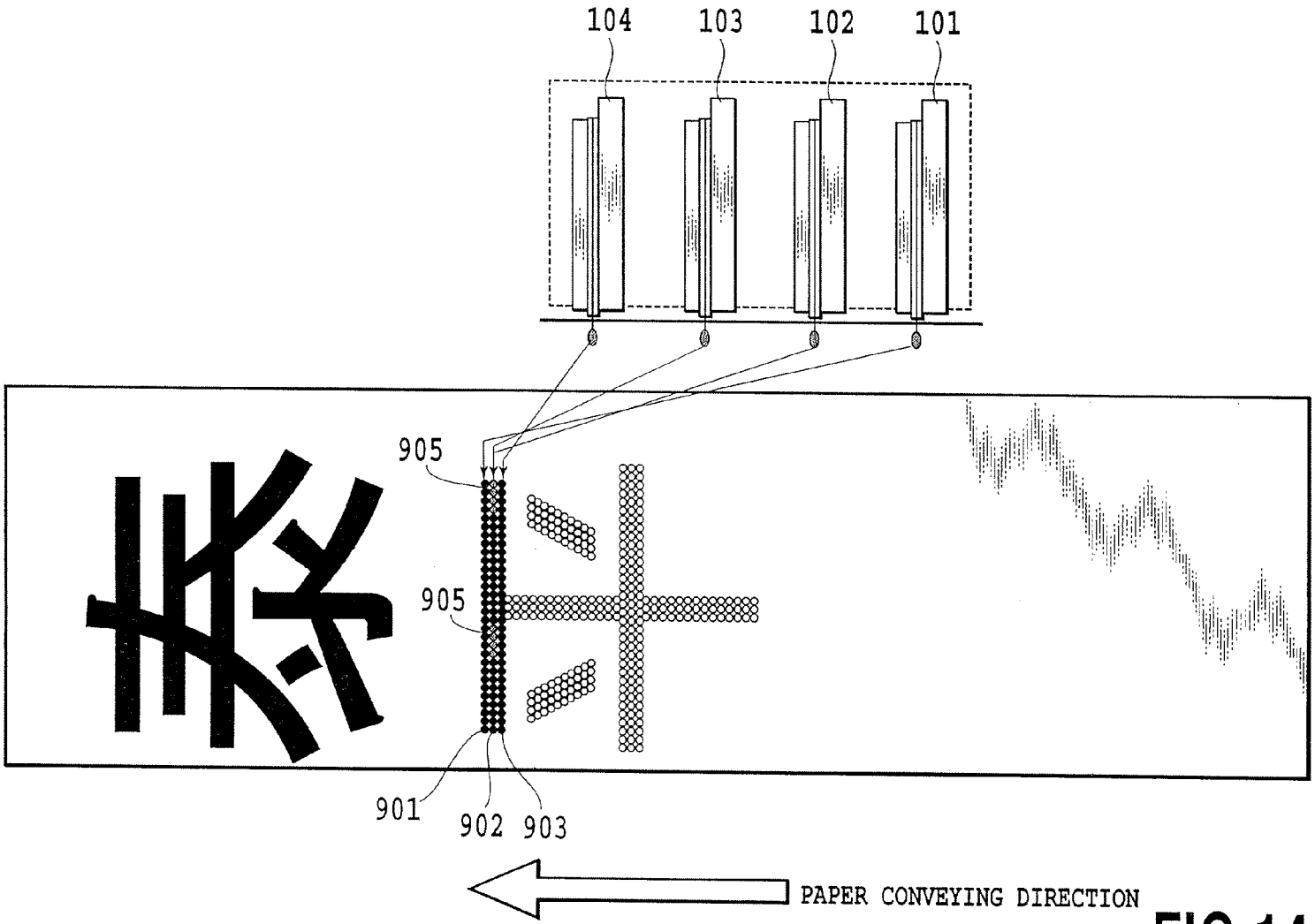
FIG. 14 is a conceptual illustration for explaining the complementary operation executed when a faulty nozzle is detected, according to the second embodiment of the present invention.

FIG. 14 is an illustration for explaining the complementary operation using the relation between the line heads in which the faulty nozzles are present. Timing charts of signals from parts in the line heads 102 and 103 having the faulty nozzles are the same as the timing charts of FIGS. 10 and 9, respectively, referred in the first embodiment. At this point, assume that the faulty nozzle detected in the line head 103 is seg65 belonging to BLOCK1 of the section consisting of seg1 to seg640 (see FIG. 6) and the section and the block do not coincide with the section and the block, respectively, containing the faulty nozzle detected in the line head 102.

When a horizontal synchronization signal is detected, a raster of data stored in the image memory 205 is transferred to the line head 101 located on the upstream end as viewed in the conveying direction of the printing medium, so that a raster image 901 is printed on the printing medium.

When a next horizontal synchronization signal is detected, a next raster of image data read out from the image memory 205 is transferred to the line head 102. At this time, the block select signal and the heat signal are appropriately controlled to make valid only driving of the nozzles belonging to BLOCK1 of the section consisting of seg1 to seg640. In other words, the main pulse MH1 alone is made valid at the time when the line head 102 is such that BE0=0, BE1=0, BE2=0, ODD=1, and EVEN=0 (see FIG. 10.) Thus, a portion 905 of a raster 902 (or hatched dots in FIG. 14) is formed. This is the portion which the line head 103 cannot print. At this time, the nozzles belonging to the sections and the blocks other than BLOCK1 are not driven, including the section and the block containing the faulty nozzle detected in the line head 102.

When a further next horizontal synchronization signal is detected, the same data as the raster of data transferred to the line head 102 is transferred to the line head 103. At this time, the block select signal and the heat signal are appropriately controlled to make valid driving of the nozzles belonging to BLOCK2 to BLOCK16 of the section consisting of seg1 to seg640 and driving of all the nozzles belonging to BLOCK1 to BLOCK16 of each of the sections consisting of seg641 to seg1280, seg1281 to seg1960, and seg1961 to seg2560, respectively. In other words, the main pulse MH1 alone is made invalid at the time when the line head 102 is such that BE0=0, BE1=0, BE2=0, ODD=1, and EVEN=0 (see FIG. 9.) Thus, the raster portion 902 (or a group of dots shown by black circles in FIG. 14) is formed to complement an image including the portion which the line head 102 cannot print.

When a still further next horizontal synchronization signal is detected, a next raster of image data read out from the image memory 205 is transferred to the line head 104 to form a raster image 903.

Thereafter, the line heads 101 to 104 are used in the same manner to form an image without a substantial reduction in the printing speed and the printing quality.

As described above, the printing apparatus according to the second embodiment uses the relation between the line heads having the faulty nozzles to perform the complementary operation block by block in a spatially corresponding section, that is, a corresponding section in relative positions as viewed in the conveying direction, according to the timing of the block select signal. This enables the complementary operation by controlling the reading and transfer of image data in raster units arranged in the image memory and by controlling the signal state of the heat signal (or the main heat pulse). Consequently, the printing apparatus according to the second embodiment eliminates the faulty nozzle complementing operation that involves image data re-arrangement, mask data generation, mask data storing means, and so on, and thus achieves the effect of being able to maintain high-quality printing using a simple configuration.

As described above, in the second embodiment, when faulty nozzles are detected in two line heads, the nozzles of normal blocks complement each other to print a raster of image data, and the four line heads print three rasters of data at a time. Accordingly, even when faulty nozzles are detected in two line heads, printing can be therefore executed at the same printing speed as that of three normal line heads. In other words, the printing apparatus according to the second embodiment achieves the effect of being able to continue to print without having to uniquely reduce the printing speed up to the speed proportional to the number of normal heads, that is, without causing a substantial decrease in the printing speed, as in the case of conventional apparatuses.

The description has been given to the above second embodiment with regard to the operation which takes place when faulty nozzles are detected in two line heads. Even when faulty nozzles are detected in three or more printing heads, however, high-quality printing can be achieved without producing situations where printing becomes quite impossible or the printing speed decreases significantly, unless the blocks having the faulty nozzles coincide with each other. In short, even when faulty nozzles are present in all the four line heads, printing can be continued unless the blocks having the faulty nozzles coincide with each other in all the line heads. For example when the blocks having the faulty nozzles are different from each other in all the line heads or when the blocks having the faulty nozzles coincide with each other in only two line heads, the relation between a pair of line heads, the faulty-nozzle-containing blocks of which do not coincide with each other, can be used to execute printing at the same printing speed as that of two normal line heads.

In the second embodiment, the relation between the line heads having the faulty nozzles is used for the complementary operation. When a faulty nozzle is detected in one line head, another normal line head, however, may be used for the same complementary operation as mentioned above.

The description has been given to the above second embodiment with regard to the processing performed when a faulty nozzle is first detected in one line head and then a faulty nozzle is detected in another line head. When faulty nozzles are detected in two or more line heads in the very beginning, the conveying speed of the printing medium, however, may be set for the complementary operation at that point in time.

In the above second embodiment, four line heads are used for normal printing. However, it is, of course, understood that the number of line heads is illustrative only and the appropriate number of line heads may be used.

(Others)

The printing apparatus according to the first embodiment is provided with the auxiliary line head. When a faulty nozzle is detected in one of the line heads for use in normal printing, the auxiliary line head complements the printing operation of the line head having the faulty nozzle. When the complementary operation is impossible, normal line heads alone are used to continue to print. The printing apparatus according to the second embodiment is not provided with the auxiliary line head but uses the relation between two line heads having faulty nozzles to complement the printing operation of one line head. However, these embodiments may be appropriately used in combination. For example, the printing apparatus is provided with the auxiliary line head, while the apparatus may use other line heads for the complementary operation if the auxiliary line head cannot complement the printing operation of the line head having the faulty nozzle, when a faulty nozzle is detected in a line head.

In the inkjet printing apparatuses according to the above embodiments, each use the line heads formed of an array of nozzles with the width corresponding to the width of the printing medium to be conveyed. However, the range of the array of nozzles is not limited to the above but may be at least a portion of the width corresponding to the width of the printing medium. As for the direction of the array of nozzles, the array of nozzles may be oriented in any direction, provided that it crosses the conveying direction of the printing medium.

In the above embodiments, the predetermined number of nozzles of each line head is grouped as a unit to form a block, and time sharing driving (or block driving) takes place block by block in each line head. However, the mode of control is not necessarily limited to the block driving in units of the predetermined number of nozzles but may be in any form, provided that the nozzles are subjected to time sharing driving. In light of the principles of the present invention that, for the complementary operation, the same divided image data is fed to one printing head and a different printing head, and the printing operation of the one printing head is made invalid only at a driving timing of a poorly ejecting nozzle, and the printing operation of the different printing head is made valid only at a driving timing of a corresponding nozzle. In other words, the number of nozzles included in each block may be appropriately set.

Furthermore, the description has been given to the above embodiments with regard to an instance where black ink is used to print a monochrome image. As for any ink other than the black ink, the present invention, however, may be applied to an instance where plural line heads are disposed to print a color image while appropriately dividing image data. In this case, it is, of course, understood that the number of types of color used may be appropriately set.

Still furthermore, the description has been given to the above embodiments with regard to the inkjet printing apparatus using the inkjet printing heads, each having an electrothermal transducer that produces thermal energy as the energy used for ink ejection. However, it is, of course, understood that the present invention may be applied to an inkjet printing apparatus using inkjet printing heads, each having a piezoelectric element or the like that produces other energy, such as mechanical energy.

The invention claimed is:

1. An inkjet printing apparatus including a plurality of inkjet printing heads for the same color ink arranged side by side in the conveying direction of a printing medium, each head formed of an array of nozzles for ink ejection in a direction crossing the conveying direction, the apparatus capable of dividing image data into pieces corresponding to the nozzle arrays, feeding the divided image data to the plurality of inkjet printing heads, and printing the divided image data, and further comprising:

complementing means which, when a poorly ejecting nozzle is present in one of the ink jet printing heads, causes a corresponding nozzle of another inkjet printing head to complement a printing operation assigned to the poorly ejecting nozzle, wherein, the complementing means feeds the same piece of divided image data to the one inkjet printing head and the other inkjet printing head, and the complementing means makes invalid the printing operation of the one inkjet printing head only at a driving timing of the poorly ejecting nozzle, and makes valid the printing operation of the other inkjet printing head only at a driving timing of the corresponding nozzle.

2. An inkjet printing apparatus as claimed in claim 1, wherein the other inkjet printing head is provided to perform the complementarity printing operation.

3. An inkjet printing apparatus as claimed in claim 2, comprising driving means which drives the respective inkjet printing heads in a time sharing manner with the respective inkjet printing heads divided into a plurality of blocks containing a plurality of nozzles, when printing the divided image data, wherein, the complementing means controls the driving means so that the printing operation of the one inkjet printing head is made invalid only at the timing of driving a block containing the poorly ejecting nozzle in the time sharing manner, and that the printing operation of the other inkjet printing head is made valid only at the timing of driving a block containing the corresponding nozzle in the time sharing manner.

4. An inkjet printing apparatus as claimed in claim 1, wherein the other inkjet printing head is the inkjet printing head in which a nozzle other than the corresponding nozzle is in a poorly ejecting condition.

5. An inkjet printing apparatus as claimed in claim 4, comprising driving means which drives the respective inkjet printing heads in a time sharing manner with the respective inkjet printing heads divided into a plurality of blocks containing a plurality of nozzles, when printing the divided image data, wherein the complementing means controls the driving means so that the printing operation of the one inkjet printing head is made invalid only at the timing of driving a block containing the poorly ejecting nozzle in the time sharing manner, and that the printing operation of the other inkjet printing head is made valid only at the timing of driving a block containing the corresponding nozzle in the time sharing manner, and the poorly ejecting nozzle of the other inkjet printing head belongs to a block other than the block containing the corresponding nozzle.

6. An inkjet printing apparatus as claimed in claim 1, wherein the printing operation is made valid or invalid according to the presence or absence of the supply of a driving signal for the ink ejection.

* * * * *